US006002369A

United States Patent [19]

Richard

[11] Patent Number: 6,002,369

[45] Date of Patent: Dec. 14, 1999

[54] MICROSTRIP ANTENNA AND METHOD OF FORMING SAME

[75] Inventor: Miguel A. Richard, Sunrise, Fla.

[73] Assignee: Motorola, Inc., Schamburg, Ill.

[21] Appl. No.: 08/977,322

[22] Filed: Nov. 24, 1997

[51] Int. Cl.[6] ..... H01Q 1/38; H01Q 1/24

[52] U.S. Cl. ..... 343/700 MS; 343/702; 343/795; 343/833

[58] Field of Search ..... 343/700 MS, 702, 343/795, 833, 834, 742, 794, 708

[56] References Cited

U.S. PATENT DOCUMENTS

| | | | |
|---|---|---|---|
| 4,370,657 | 1/1983 | Kaloi | 343/700 MS |
| 4,706,050 | 11/1987 | Andrews | 333/205 |
| 4,980,694 | 12/1990 | Hines | 343/702 |
| 5,170,173 | 12/1992 | Krenz et al. | 343/702 |
| 5,229,777 | 7/1993 | Doyle | 343/700 MS |
| 5,767,809 | 3/1996 | Chuang et al. | 343/700 MS |

FOREIGN PATENT DOCUMENTS

| | | |
|---|---|---|
| 52-215807 | 12/1983 | Japan . |
| 52-215808 | 12/1983 | Japan . |

OTHER PUBLICATIONS

"Transactions on Antennas and Propagation," IEEE vol. 43, No. 3, Mar. 1995.

"Improved Bandwidth of Microstrip Antennas using Parasitic Elements," IEE Proc. vol. 127, Pt. H. No. 4, Aug. 1980.

*Primary Examiner*—Don Wong
*Assistant Examiner*—James Clinger
*Attorney, Agent, or Firm*—Barbara R. Doutre

[57] ABSTRACT

A microstrip antenna (300) provides improved bandwidth control by gap coupling first and second triangular patches (310, 312) over a ground plane (322). The first and second triangular patches (310, 312) are resonant at different frequencies. The use of gap-coupled triangular patches (310, 312) allows for smaller structured microstrip antennas.

12 Claims, 4 Drawing Sheets

MICROSTRIP ANTENNA AND METHOD OF FORMING SAME

TECHNICAL FIELD

This invention relates in general to antennas and more specifically to microstrip antennas.

BACKGROUND

There is a continuing interest in personal communications systems, such as cellular telephones and pagers. Product requirements for these systems typically call for very small, lightweight, and low cost antennas. Microstrip antennas have been used in personal communication systems to accommodate these smaller design requirements, because they can be fabricated using inexpensive printed circuit board technology. Over the years, many forms of microstrip antennas have been developed, the "patch" antenna being one of the most popular. Patch antennas typically comprise radiator elements in the form of rectangular or square patches disposed onto a substrate over a ground plane. The substrate materials used for patch antennas typically have dielectric constants ($\beta_r$) below 10 in order to achieve wider bandwidths. However, the major weakness of microstrip antennas still remains their very narrow impedance bandwidth characteristics.

FIG. 1 shows a prior art patch antenna 100 formed with a single rectangular patch having a resonant length (along length 110) characterized by equation:

$$L \approx \frac{c}{2f\sqrt{\varepsilon_r}},$$

c is the speed of light, f is the resonant frequency, and $\epsilon_r$ is the dielectric constant of substrate. To improve the bandwidth of this single resonant circuit, additional patches can be added to provide two resonant circuits. FIG. 2 shows a prior art patch antenna 200 with two gap-coupled rectangular patches 202, 204. The advantage of the two gap-coupled rectangular patches over the single patch is an increase in bandwidth, however the disadvantage is that the gap-coupled rectangular patches require an increase in the overall size of the antenna to achieve the improved bandwidth.

As an example, a single patch antenna, such as the antenna shown in FIG. 1 (not to scale), can be designed to resonate at a frequency of 1.85 gigahertz (GHz) when formed on a ceramic filled polytetrafluoroethylene (PTFE) substrate 102 having a dielectric constant $\epsilon_r$=6. Substrate dimensions measuring 4.4 centimeters (cm) along width 104, by 3.7 cm along length 106, with a patch size measuring 3.8 cm along width 108, by 3.1 cm along length 110 produce a bandwidth of approximately 13.8 megahertz (MHz). The bandwidth can be increased by providing a longer substrate, such as the antenna shown in FIG. 2 (not to scale), measuring 6.9 cm along length 206 and with the second patch 204 having the same width but a slightly longer length 208 of 3.15 cm. With this second configuration the bandwidth increases to approximately 78 MHz, but the size of the antenna structure has effectively doubled. Increasing the size of the antenna structure by adding multiple patches thus makes an antenna less attractive for use in portable communications equipment which is troublesome since small size is particularly desirable in hand-held products, such as cellular handsets. Accordingly, there is a need for an improved microstrip antenna which provides a small, light weight, cost effective structure.

DETAILED DESCRIPTION OF THE PREFERRED EMBODIMENT

Figure 1:
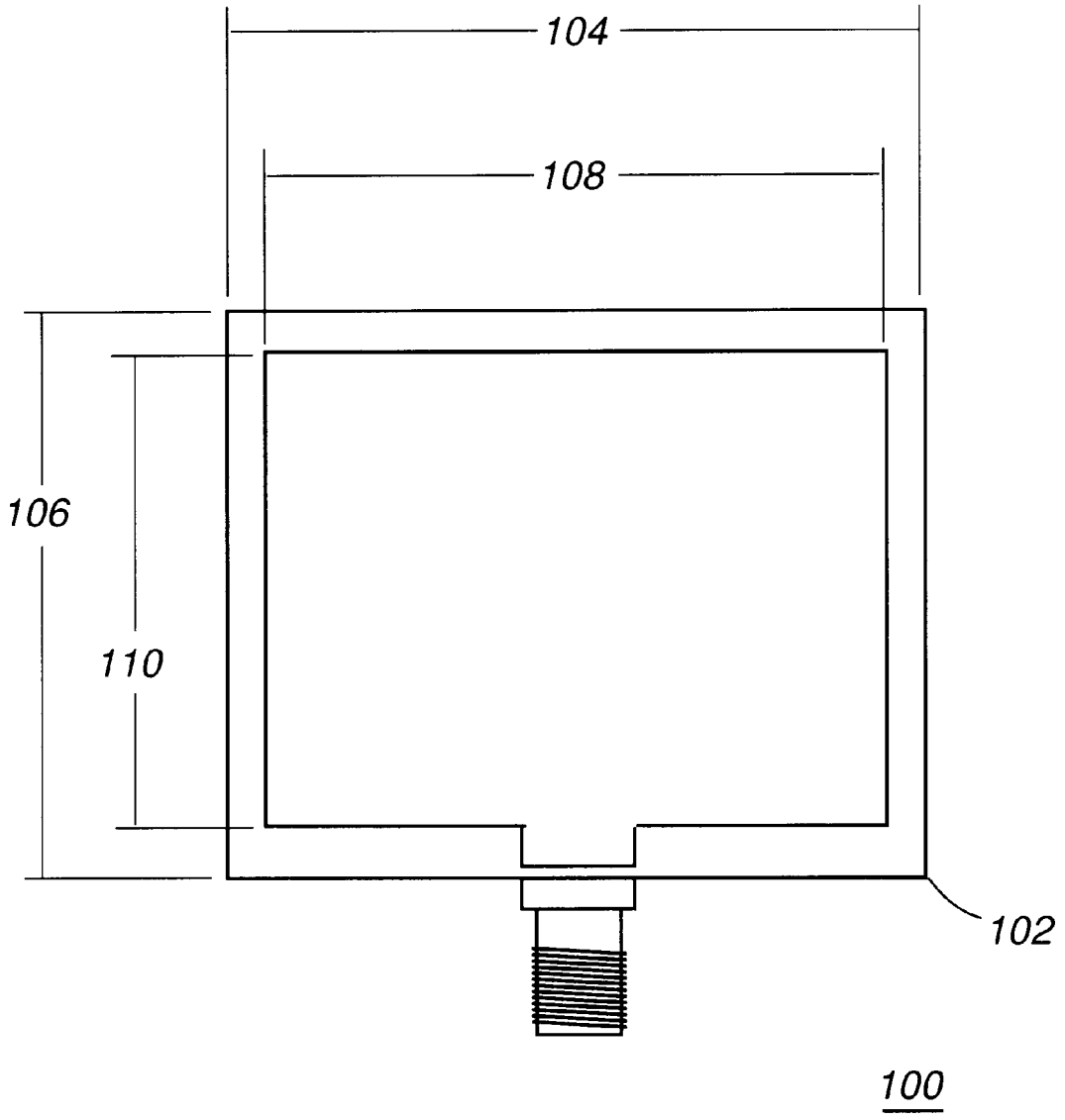
FIG. 1 (PRIOR ART)
FIG. 1 is a first prior art patch antenna.
Figure 2:
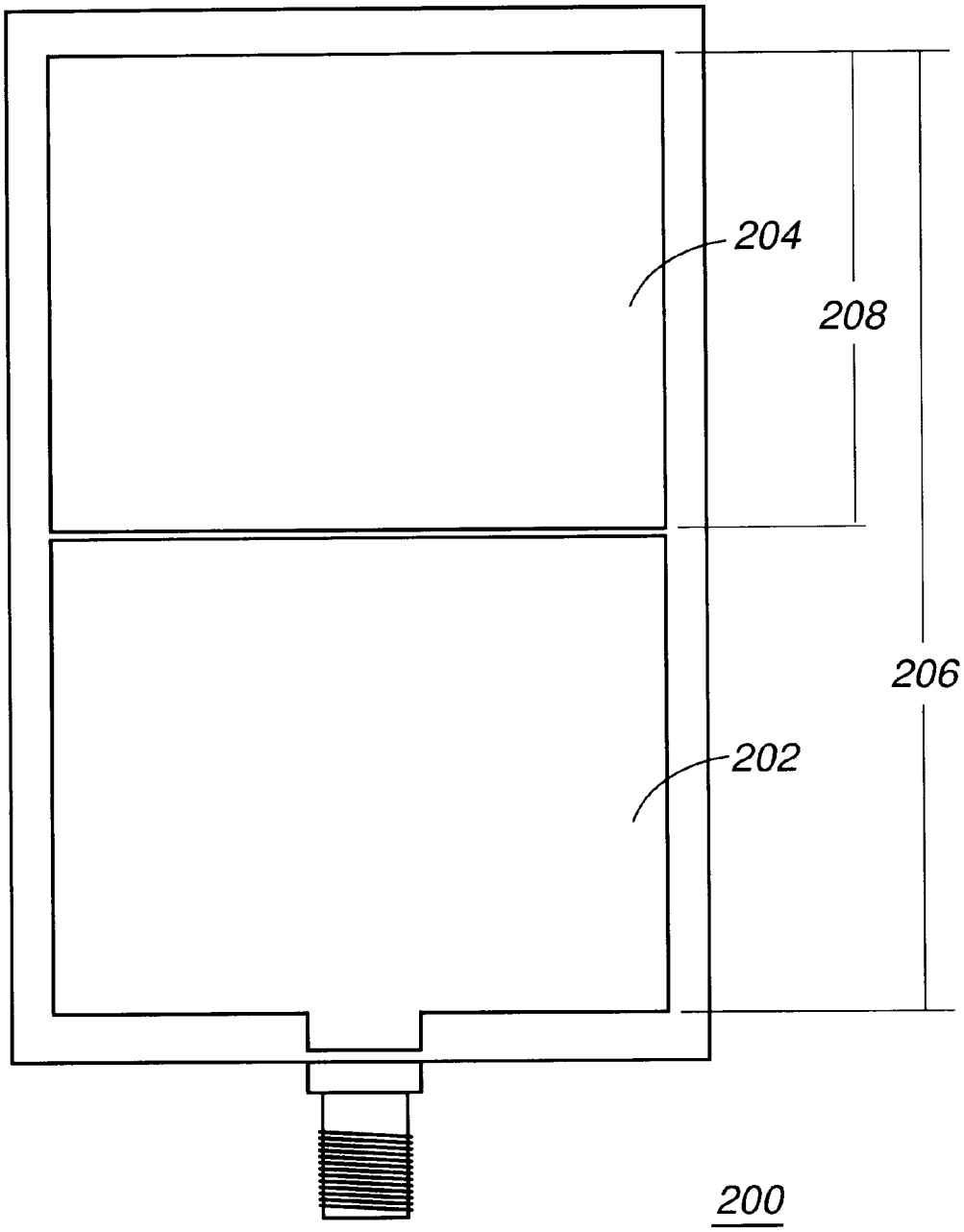
FIG. 2 (PRIOR ART)
FIG. 2 is a second prior art patch antenna.
Figure 3:
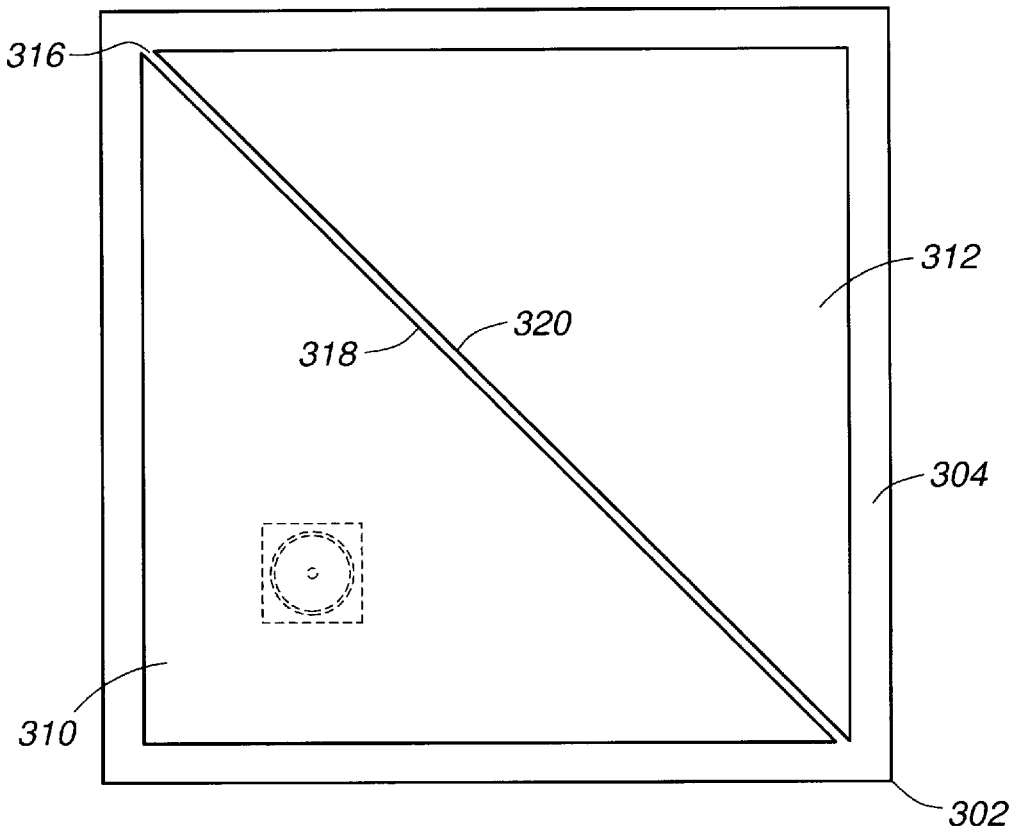
FIG. 3 is a microstrip antenna structure formed in accordance with the present invention.
Figure 4:
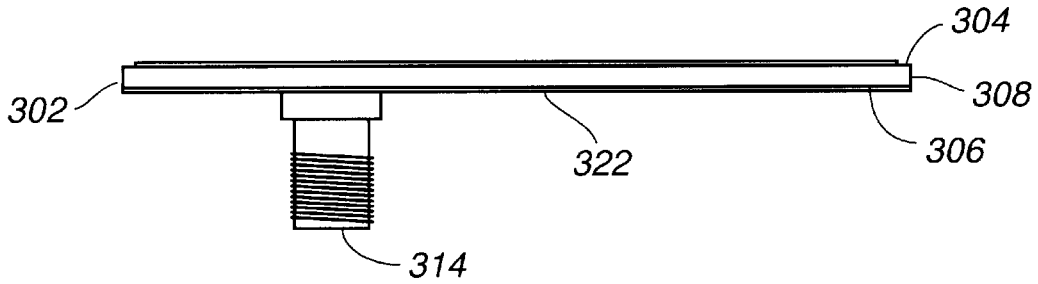
FIG. 4 is a side view of the antenna structure of FIG. 3.

In designing microstrip antennas for improved bandwidth performance the issues of size constraints are of significant importance. FIG. 3 is a microstrip antenna structure 300 formed in accordance with the present invention. FIG. 4 shows a side view associated with the antenna structure of FIG. 3 of the present invention Referring to FIGS. 3 and 4, antenna structure 300 comprises a substrate 302 having top, bottom, and side surfaces 304, 306, 308 respectively. First and second radiator elements 310, 312 are disposed onto the top surface 304 of the substrate 302 preferably using conventional printed circuit board techniques. The radiator elements 310, 312 are formed of a conductive material, such as copper. The bottom surface 306 of substrate 302 is covered with a conductive material, preferably the same material used for radiator elements 310, 312, to provide a ground plane 322 for the antenna structure 300. In accordance with the present invention, the first and second radiator elements 310, 312 are formed of first and second gap-coupled triangular shaped radiator elements, also referred to as triangular shaped radiator patches, disposed over the ground plane 322. A feed point 314 is coupled to the microstrip antenna 300 to transfer a radio frequency (RF) signal to and from the antenna. The RF feed 314 can comprise a coaxial feed, a microstrip feed or other appropriate signal interface means. The RF feed 314 couples the RF signal to and from the first radiator element 310. In accordance with the present invention, the RF signal is capacitively coupled between the triangular shaped radiator patches 310, 312 across gap 316.

Using triangular shaped radiator elements 310, 312 provides improved bandwidth over that of a single patch while keeping the overall structure size small enough to be usable in portable products. The size of the ground plane can vary from application to application, however, the ground plane preferably conforms to the size of the substrate material that the radiator elements 310, 312 sit on. As with all patch antennas, for optimum performance the ground plane should extend beyond the edges of the radiator elements 310, 312.

In accordance with the preferred embodiment of the invention, the first triangular shaped radiator element 310 is formed as a first right angled isosceles triangle disposed on the substrate and characterized by a first hypotenuse 318. The second triangular shaped radiator element 312 is formed as a second right angled isosceles triangle disposed on the substrate and characterized by a second hypotenuse 320. In accordance with the preferred embodiment, the first and second right angled isosceles triangles are gap-coupled along their first and second hypotenuses 318, 320. In accordance with the preferred embodiment, the first and second right angled isosceles radiator elements are formed to be resonant at slightly different frequencies to provide for an increased bandwidth. Bandwidth control can be varied by varying the length of either hypotenuse 318, 320. The resonant length is characterized along the equal sides by equation:

$$a \approx \frac{\sqrt{2}}{2} \frac{c}{f\sqrt{\varepsilon_r}},$$

c is the speed of light, f is the resonant frequency, and $\epsilon_r$ is the dielectric constant of substrate.

As an example, measured data was taken on a patch antenna formed in accordance with the preferred embodiment wherein two right angled isosceles triangular patches were disposed upon a substrate of ceramic filled PTFE having a dielectric constant of $\epsilon_r$=6. The substrate measured 5.1 cm square (all dimensions given are approximate), and the bottom surface of the substrate was covered with a ground plane. A first triangular shaped radiator patch was formed of two sides measuring 4.55 cm. A second triangular shaped radiator patch was formed of two sides measuring 4.5 cm. The two radiator patterns were gap-coupled across their respective hypotenuses through a gap of 0.5 mm. Each triangular patch resonated at a slightly different frequency to provide for an increase in bandwidth. For this example, the patches were dimensioned to provide a resonant frequency of 1.85 GHz and a bandwidth of approximately 52 MHz—a significant improvement over the single patch antenna structure and much smaller than the two rectangular patch configuration previously described. One skilled in the art appreciates that a variety of substrate materials, RF feed mechanisms, and conductive materials can be utilized and dimensioned to provide an antenna structure suited to the particular application.

A microstrip antenna can now be formed which provides a new means for controlling bandwidth in a smaller physical structure. The following steps summarize the method by which the bandwidth can be controlled by forming an antenna structure in accordance with the preferred embodiment of the invention. First, a substrate having a ground plane is provided. Next, a first conductive metal patch in the form of a right angled isosceles triangle is patterned onto the substrate over the ground plane, the first conductive metal patch operating at a first resonant frequency and characterized by a first hypotenuse having a predetermined length. A second conductive metal patch in the form of a right angled isosceles triangle is patterned onto the substrate over the ground plane, the second conductive metal patch operating at a second resonant frequency and characterized by a second hypotenuse having a predetermined length. Gap-coupling the first and second conductive metal patches along their respective hypotenuses and altering the predetermined lengths of the first and second hypotenuses varies the bandwidth of the antenna. A radio frequency (RF) feed is provided to either the first or second conductive metal patch to feed a radio frequency signal to the antenna.

Figure 5:
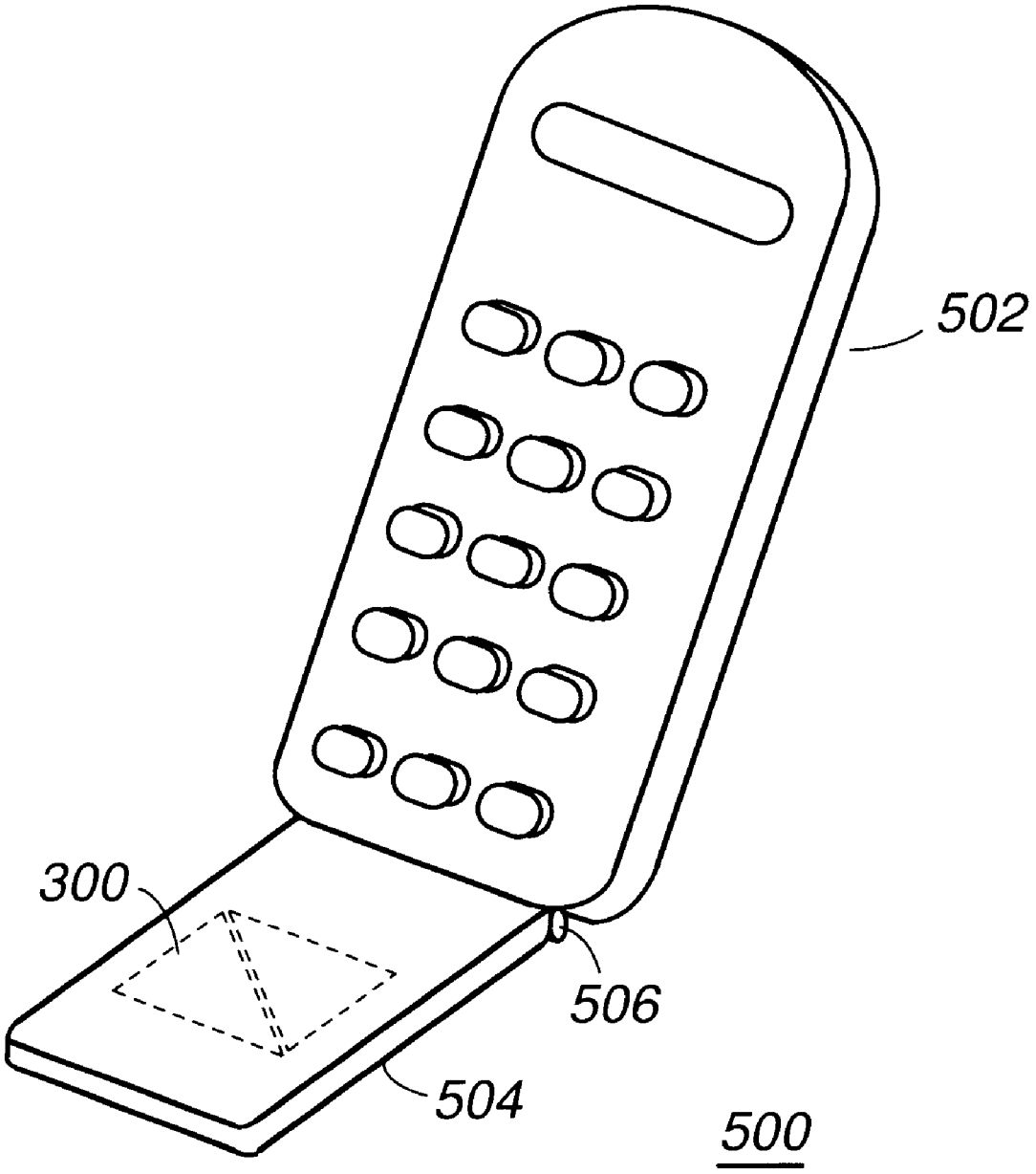
FIG. 5 is a radio having a microstrip antenna formed in accordance with the present invention.

FIG. 5 shows a radio 500 incorporating the antenna 300 described by the invention. Radio 500 comprises a housing 502 and a flap 504 coupled to the housing. Coupled to the flap 504 is microstrip antenna 300 as described by the invention and shown in phantom. The electrical interconnect between the antenna 300 and a radio transceiver (not shown) located within the housing 502 can be achieved through a flexible RF coaxial cable (not shown) through hinge 506 or other electrical interconnect means, such as inductive coupling. In accordance with the present invention, microstrip antenna 300 includes first and second gap-coupled triangular shaped radiator elements. The antenna 300 described by the invention radiates mostly into a half plane, thereby reducing potential interference with other communication products worn by the user, such as a hearing aid. The use of gap-coupled triangular patches as radiator elements allows for smaller dimensioned flaps to be implemented in radio products. The antenna geometry is easily implemented using conventional printed circuit board techniques.

Accordingly, the antenna configuration described by the invention provides a microstrip antenna which is particularly well suited for applications having strict size constraints. The use of gap-coupled triangular radiator elements allows smaller dimensions for length and width while providing improved bandwidth over prior art single patch antennas. Communications products including pagers, portable two-way radios, and cellular handsets can benefit from the low cost, small size, and ease of manufacturability associated with the antenna geometry described by the invention. The benefits of the antenna structure described by the invention make it a desirable approach for today's smaller communication devices.

While the preferred embodiments of the invention have been illustrated and described, it will be clear that the invention is not so limited. Numerous modifications, changes, variations, substitutions, and equivalents will occur to those skilled in the art without departing from the spirit and scope of the present invention as defined by the appended claims.

What is claimed is:

1. A microstrip antenna, comprising:

a substrate having a ground plane;

first and second right angled isosceles triangular shaped radiator elements disposed over the ground plane and gap-coupled along their hypotenuses; and a radio frequency (RF) feed point coupled to the first right angled isosceles triangular shaped radiator element.

2. A microstrip antenna, including:

a substrate having a ground plane;

a first right angled isosceles radiator element disposed on the substrate and characterized by a first hypotenuse; and a second right angled isosceles radiator element disposed on the substrate and characterized by a second hypotenuse, the first and second right angled isosceles radiator elements being gap-coupled along the first and second hypotenuses, the first and second hypotenuses determining the bandwidth of the microstrip antenna.

3. A microstrip antenna as described in claim 2, wherein the first and second right angled isosceles radiator elements are resonant at different frequencies.

4. A microstrip antenna, comprising:

a substrate having first and second opposing surfaces, the second surface providing a ground plane;

a feed point coupled to the substrate to provide a radio frequency (RF) signal;

a first radiator element disposed on the first surface of the substrate, the first radiator element forming a first geometric right angled isosceles triangle having a first hypotenuse; and a second radiator element disposed on the first surface of the substrate, the second radiator element forming a second geometric right angled isosceles triangle having a second hypotenuse, the second hypotenuse being gap coupled to the first hypotenuse, the first and second radiator elements providing first and second resonant frequencies.

5. A patch antenna structure, comprising:

a substrate having a ground plane;

first and second right angled isosceles triangular shaped radiator patches disposed on the substrate above the ground plane, the first triangular right angled isosceles triangular shaped radiator patch being gap-coupled to the second right angled isosceles triangular shaped radiator patch along their hypotenuses; and a conductive feed coupled to the substrate for feeding a radio frequency (RF) signal.

6. An antenna structure as described in claim 5, wherein the conductive feed comprises a coaxial feed.

7. An antenna structure as described in claim 5, wherein the conductive feed comprises a microstrip feed line.

8. A microstrip antenna structure, comprising:

a substrate having top and bottom surfaces, the bottom surface having a ground plane;

first and second radiator patterns disposed onto the top surface of the substrate, said first radiator pattern formed as a first right angled isosceles triangle and said second radiator pattern formed as a second right angled isosceles triangle, the first and second right angled isosceles triangles characterized by first and second hypotenuses respectively, the first and second radiator patterns capacitively coupled along the first and second hypotenuses; and a radio frequency (RF) feed coupled to one of the first or second radiator elements.

9. A method of forming a microstrip antenna structure, comprising the steps of:

providing a substrate having a ground plane;

patterning a first conductive metal patch in the form of a right angled isosceles triangle onto the substrate over the ground plane, said first conductive metal patch operating at a first resonant frequency and characterized by a first hypotenuse having predetermined length; patterning a second conductive metal patch in the form of a right angled isosceles triangle onto the substrate over the ground plane, said second conductive metal patch operating at a second resonant frequency and characterized by a second hypotenuse having a predetermined length; forming a gap between the first and second conductive metal patches along the first and second hypotenuses so as to allow for electromagnetic coupling between the first and second conductive metal patches; and coupling a radio frequency feed to the first conductive metal patch to feed a radio frequency signal.

10. The method of claim 9, further comprising the step of altering the predetermined lengths of the first and second hypotenuses to vary the bandwidth of the antenna microstrip antenna structure.

11. A radio, comprising:

a housing;

a microstrip antenna coupled to the housing, the microstrip antenna formed of first and second gap-coupled triangular shaped radiator elements;

a feed point coupled to the microstrip antenna for transferring a radio frequency (RF) signal; and wherein the first and second gap-coupled triangular shaped radiator elements approximate first and second right angled isosceles triangles characterized by first and second hypotenuses respectively, the first and second gap-coupled triangular shaped radiator elements being gap-coupled along the first and second hypotenuses.

12. A radio as described in claim 11, wherein the radio housing includes a flap and the microstrip antenna is coupled to the flap.

* * * * *